United States Patent [19]

Rudd

[11] 3,998,126

[45] Dec. 21, 1976

[54] DELAYED BOLT ACTION FOR FIREARM

[76] Inventor: Ross Rudd, 9301 Yolanda Ave., Northridge, Calif. 91324

[22] Filed: Sept. 3, 1974

[21] Appl. No.: 502,541

[52] U.S. Cl. ..... 89/184
[51] Int. Cl.[2] ..... F41D 11/06
[58] Field of Search ..... 89/184

[56] References Cited

UNITED STATES PATENTS 2,356,726 8/1944 Reising ..... 89/184

*Primary Examiner*—Stephen C. Bentley
*Attorney, Agent, or Firm*—Matthew P. Lynch

[57] ABSTRACT

A delayed blow back bolt action for a firearm includes a bolt and a slide which are movable together in the receiver frame and are disposed for limited movement with respect to one another. The bolt and slide have cooperating camming surfaces which cause a relatively large displacement of the slide in relation to the displacement of the bolt when the forces attendant to the discharge of a round in the firearm are initially applied to the bolt. The bolt is provided with a lug which engages a locking recess in the receiver frame of the firearm, and the lug and recess have cooperating camming surfaces, such that a surface of the recess provides an opposing force to the force generated by the discharge of a round from the firearm, which force is exerted against one end of the bolt. As such a force is supplied to the end of the bolt, the locking lug is forced out of the locking recess, thereby camming the slide in a direction which is along the longitudinal axis of the bolt. The delay caused by such camming action and movement of the slide is sufficient to permit the discharge of a round from the barrel of the firearm and substantial dissipation of the resulting gases. The moment of the moving bolt and slide, after the locking lug is removed from the locking recess, is sufficient to force the bolt and slide to a rearward position to open the breach, thereby cocking the hammer and permitting a second round of ammunition to be chambered.

7 Claims, 12 Drawing Figures

DELAYED BOLT ACTION FOR FIREARM

BACKGROUND OF THE INVENTION

1. Field of the Invention

This invention relates generally to a bolt action for a firearm and more particularly to a delayed blow back bolt action which permits the discharge of a round of ammunition from the end of the barrel of the firearm and the substantial dissipation of the expended gases before the bolt is permitted to move along its longitudinal axis to open the breach of the firearm. The present invention has particular application in bolt action rifles and cannons.

2. Prior Art

The great majority of bolt action firearms employ gas parts and pistons to unlock the bolt to permit it to move to an open breach position. More particularly, such firearms are provided with a port in the barrel which permits gases to escape from the barrel into an adjacent chamber after a bullet has passed thereover. When a round of ammunition is fired, the cartridge case remains at one end of the barrel and the gases formed by the explosion force the bullet to travel down the length of the barrel. As the bullet passes this port, the gases escape to the adjacent chamber and apply a force to a piston therein. Displacement of the piston, through appropriate linkages, unlocks the bolt to permit the remaining gases in the barrel to force the bolt to an open breach position.

Another delayed bolt action mechanism is employed in a German service rifle designated model G-3 manufactured by Heckler and Koch and designed by Cetme. This delayed action bolt mechanism employs a pair of roller bearings which are mounted in slots on opposite sides of a bolt and are disposed for being received in corresponding recesses in the receiver frame. The rollers act on camming surfaces of the firing pin, such that the firing pin must first by forced in a rearward direction before the rollers will disengage from the recesses in the receiver frame. That is, when an ammunition round is fired, the pressure within the firing chamber increases drastically to apply a rearward force to the face to the bolt via the cartridge case. This force attempts to move the bolt in a rearward direction, but is impeded by the rollers engaging the recesses in the receiver frame.

As the rollers are cammed out of the recesses, they act on the camming surfaces of the firing pin forcing it in a rearward direction. Until the firing pin has moved in a rearward direction with respect to the bolt, the rollers will not disengage from their respective recesses. The time required to move the firing pin a sufficient distance in a rearward direction to permit the rollers to become disengaged from the recesses corresponds to the amount of delay between the firing and the relatively rapid movement of the bolt from a closed breach position to an open breach position.

When an ammunition round is fired, the pressure within the cartridge case increases greatly, tending to force the bullet down and out the end of the barrel and tending to force the cartridge case against the end of the bolt. If the bolt is permitted to move immediately upon the application of a force thereto from the cartridge case, the cartridge case will be extracted and gases will be released from the open breach before the bullet has had an opportunity to travel the length of the barrel. Under such conditions, the bullet will not achieve its maximum velocity, since the force of the expended gases thereon will be dissipated before it has exited from the end of the barrel.

Occasionally, a cartridge case will rupture if the bolt is permitted to move immediately upon the application of a force thereto from the cartridge case. That is, the pressure within the cartridge case will tend to force its side wall against the inner periphery of the barrel, thereby holding the side wall fixed, and will tend to force its base or bottom wall outwardly of the end of the barrel, which action may result in a rupture between the side wall and the bottom wall. If such a rupture occurs, the side wall will not be extracted from the barrel, but the bolt will be forced back by the gases acting on the bottom wall of the cartridge case. When the bolt moves forward again to the closed breach position, a second cartridge will be forced into the chamber containing the ruptured side wall of the previously fired cartridge. Accordingly, it can be appreciated that some type of mechanism is required to maintain the bolt locked in a closed breach position until the bullet has travelled a considerable distance down the length of the barrel. The above two mentioned delayed action bolt mechanisms provide such a function.

It can be appreciated that the gas piston type of delayed bolt action mechanism employs a number of working parts which must operate through linkages to unlock the bolt. The reliability of the mechanism decreases as the number of working parts required increases. Furthermore, the gas port is subject to clogging and is not easily accessible for being cleaned. The chamber associated with the port and housing the piston is subjected to the products of the combustion and is also difficult to clean. Accordingly, it can be appreciated that the gas piston type of delayed bolt action mechanism suffers from a number of disadvantages.

The second type of delayed action bolt mechanism discussed above also suffers from a number of disadvantages which are considerably different from those associated with the gas piston type. In the roller and cam action type of mechanism, the rollers are in engagement with recesses when the breach is closed. These recesses have a depth which is less than the radius of the rollers, such that rearward movement of the bolt will tend to force the rollers out of the recesses. The rollers are held into the recesses by camming surfaces on the firing pin which extends through the bolt. Therefore, the firing pin must be forced in a rearward direction against the force of the firing pin spring by the camming action of the rollers thereon. The relatively light weight firing pin and relatively small spring modulus of the firing pin spring do not provide the desired amount of inertia to the system to generate the required amount of delay.

Furthermore, as the rollers move out of the locking recesses, the camming angle between the edge of the recesses and the rollers increases, thereby tending to permit the rollers to move at a faster rate out of the recesses as the bolt moves rearwardly. It can be readily appreciated that the delay caused by this mechanism cannot be easily changed by altering the design parameters, since the firing pin cannot be increased in weight considerably and the modulus of the firing pin spring cannot be increased without severely effecting the operation of the firing mechanism. Furthermore, the rollers cannot be increased in size, since the size of the rollers determines the distance traveled by the bolt before the rollers disengage from the recesses to permit the bolt to move without further resistance therefrom to open the breach. That is, the bolt will move in a rearward direction a distance equal to the radius of the rollers before it is fully unlocked. If this distance is too great, the cartridge case will stretch under the existing pressures and may rupture. As discussed above, such a rupture of the cartridge case is not desirable.

SUMMARY OF THE INVENTION

Accordingly, it is an object of the present invention to provide a delayed action bolt mechanism for a firearm which employs relatively few moving parts.

It is another object of the present invention to provide a delayed action bolt mechanism for a firearm which has a relatively high degree of reliability.

A further object of the present invention is to provide a delayed action bolt mechanism for a firearm in which the bolt moves a relatively small distance while unlocking, thereby reducing the possibility of rupturing the cartridge case.

Another object of the present invention is to provide a delayed action bolt mechanism for a firearm which is capable of opening the breach with less pressure in the barrel and after the bullet has travelled a considerable distance down the length of the barrel.

These and other objects of the present invention are attained by a bolt mechanism which includes a bolt member and a slide member which are movable together in the receiver frame of a firearm and which are disposed for limited movement with respect to one another. Cooperating camming surfaces on the bolt and slide cause a relatively large displacement of the slide member in relation to the displacement of the bolt member when the forces attendant to the discharge of a round in the firearm are initially applied to the bolt. Cooperating camming surfaces are also provided on the bolt member and receiver frame to cause the bolt member to move the slide member while such surfaces are moving with respect to one another. In essence, the bolt member, slide member, and receiver frame and their cooperating camming surfaces provide a motion amplifier, such that a relatively small displacement of the bolt member generates a relatively large displacement of the slide member while the bolt member is unlocking. The momentum of the slide member is sufficient to carry the bolt member to an open breach position after it is unlocked.

The invention, however, as well as other objects, features and advantages thereof will be more fully realized and understood from the following detailed description, when taken in conjunction with the accompanying drawings, wherein:

DESCRIPTION OF THE PREFERRED EMBODIMENTS

Figures 1, 2, 3, 4, 6, 7:
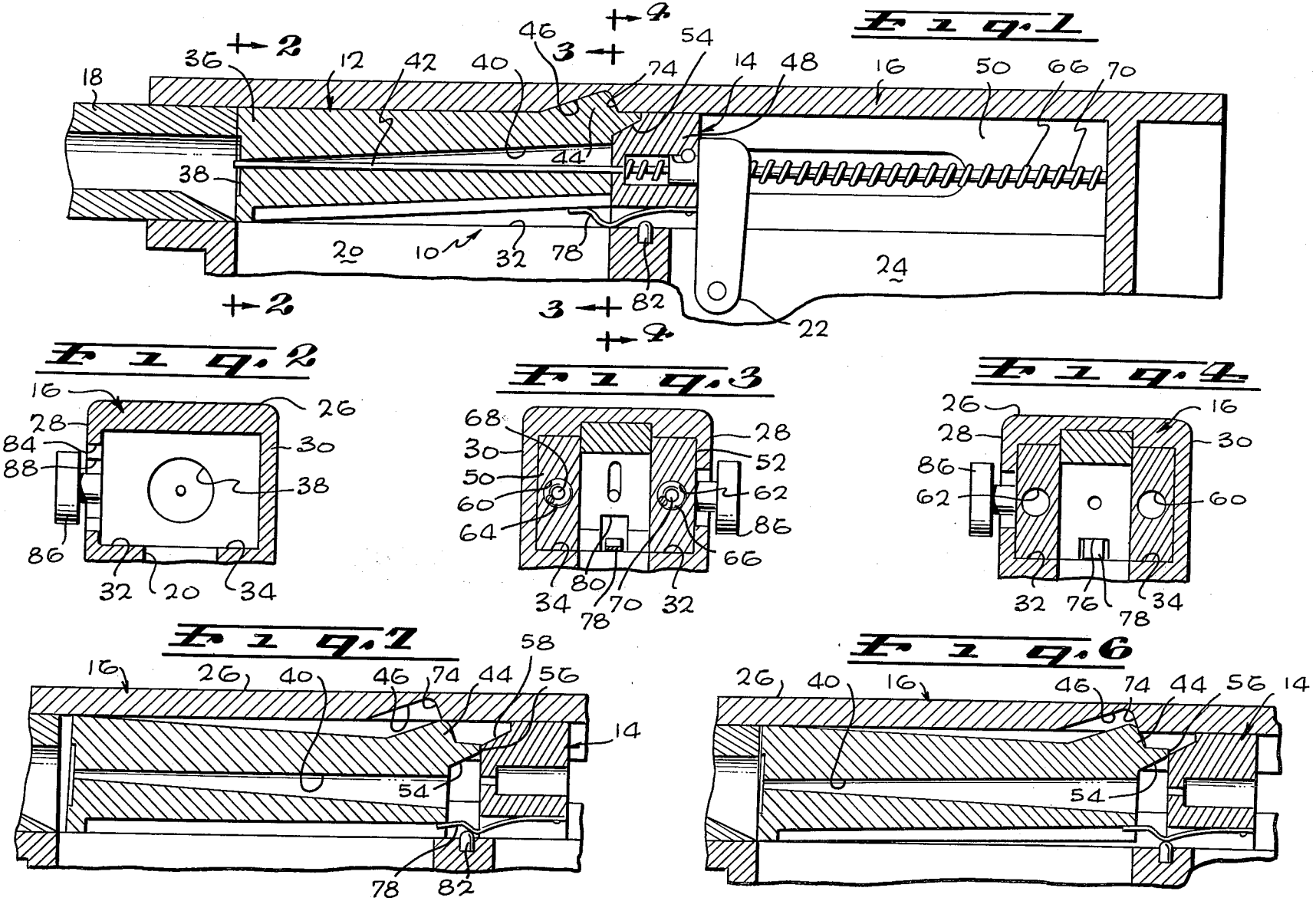
FIG. 1 is a sectional view partially broken away, along a longitudinal axis of the bolt, and illustrating a delayed bolt action mechanism constructed in accordance with the principles of the present invention.
FIG. 2 is a sectional view taken generally along line 2—2 of FIG. 1.
FIG. 3 is a sectional view taken generally along line 3—3 of FIG. 1.
FIG. 4 is a sectional view taken generally along line 4—4 of FIG. 1.
FIG. 6 is a sectional view along the longitudinal axis of the bolt mechanism illustrated in FIG. 1, with certain parts not shown therein and with the bolt member in a different position.
FIG. 7 is a sectional view similar to that of FIG. 6, but with the bolt member illustrated in yet another position.

Like reference numerals throughout the various views of the drawings are intended to designate the same elements.

With particular reference to FIG. 1, there is shown a delayed action bolt mechanism, generally designated with the reference numeral 10 and which is constructed in accordance with the principles of the present invention. The bolt mechanism 10 includes a bolt member 12 and a slide member 14 which are movable together along the longitudinal axis of the bolt member in a receiver frame 16 of a firearm. The receiver frame 16 supports a barrel 18 at one end thereof and is disposed for receiving the stock piece of a firearm at the other end thereof. The receiver frame 16 is provided with a chamber 20 for receiving a magazine therein. The firing mechanism, which includes a hammer 22, is supported in a chamber 24 of the frame 16. It will be appreciated that certain illustrated parts of the firearm, including the receiver frame and its associated magazine chamber and firing mechanism chamber, are illustrated somewhat diagramatically, since the exact details of their construction are not needed for purposes of explaining the bolt mechanism of the present invention.

As shown more clearly in FIGS. 2–4, the receiver frame 16 is provided with a top wall 26 and a pair of side walls 28 and 30. The side walls 28 and 30 are provided with internal shoulders 32 and 34 provide a rectangular cross sectional opening for receiving the bolt mechanism. It can be readily appreciated, however, that the cross sectional shape of the receiver frame can be changed as desired from that illustrated in the drawings. The rectangular cross sectional shape of the bolt mechanism, however, is desirable, since it increases the weight of the bolt mechanism without increasing the external width dimensions thereof.

The bolt member 12 is provided with an enlarged portion 36 at one end thereof (see FIGS. 1 and 5) which is disposed for riding on the shoulders 32 and 34 while moving between an open breach position and a closed breach position in the receiver frame 16. A recess 38 is provided in the face of the bolt member 12 for receiving the base or bottom wall of an ammunition round. A tapered or wedge shaped aperture 40 extends through the bolt member 12 and is disposed for receiving a firing pin 42 therein.

The face of the bolt member 12 or forward end thereof is conformably shaped to the opening in the receiver frame defined by the inner surfaces of the walls 26, 28 and 30 and by the shoulders 32 and 34. A locking lug 44 extends from an upper surface of the bolt member 12 and is disposed from being received in a locking recess 46 in the top wall 26 of the receiver frame 16. The bottom surface of the bolt member 12 is tapered with respect to its upper surface, such that the dimension from the top of the lug 44 to the bottom surface of the bolt 12 is approximately equal to the distance from the shoulders 32 to 34 to the inside surface of the wall 26. Accordingly, if the locking lug 44 is removed from the recess 46, the bolt member 12 is capable of moving along its longitudinal axis within the receiver frame 16 from a closed breach position to an open breach position.

The slide member 14 is formed of a body portion 48 and a pair of side wall portions 50 and 52 integrally connected to one another to form an integral U-shaped member. The bolt member 12, rearward of the enlarged portion 36, has a thickness corresponding to the inner surfaces of the side portions 50 and 52 as shown in the drawings. The bolt member 12 is disposed from being received between the side wall portions 50 and 52 of the slide member 14.

The bolt member 12 is provided, on its rearward surface, with a camming surface 54 which terminates in a shoulder 56. The inner surface of the body portion 48 of the slide member 14 is provided with a camming surface 58. More particularly, the inner surface of the body portion 48 is conformably shaped to the rearward surface of the bolt member 12.

The slide member 14 is provided with a pair of apertures 60 and 62 which extend through the body portion 48 and through a respective one of the side wall portions 50 and 52. A pair of recoil springs 64 and 66, which are supported by rods 68 and 70, respectively, extend from a back wall 72 of the receiver frame 16 and into the apertures 60 and 62.

When a force is applied to the face of the bolt member 12, the bolt member 12 attempts to move in a rearward direction in the receiver frame 16, thereby transferring such a force to a camming surface 74 of the recess 46 and to the camming surface 58 of the slide member 14. The camming surface 74 lies in a plane which intersects the longitudinal axis of the bolt member 12 at an angle which is greater than the angle of intersection of the plane in which the camming surface 58 lies with the longitudinal axis of the bolt. When such a force is applied to the face of the bolt member 12, the bolt member 12 will tend to move in a rearward direction, thereby causing the locking lug 44 to be cammed out of the locking recess 46. As the locking lug 44 moves out of the locking recess 46, the camming surface 54 bearing against the camming surface 58 translates the slide member 14 in a longitudinal direction. This motion continues until the camming surface 54 moves off the camming surface 58 and the shoulder 56 engages an inner surface of the body portion 48 of the slide member 14. Partial movement of the locking lug 44 out of the locking recess 46 is illustrated in FIG. 6 and complete movement of the locking lug 44 out of the locking recess 46 is illustrated in FIG. 7.

It will be noted from FIG. 6 that as the camming surface 54 is moving off the surface 58, the bolt member 12 moves a relatively small distance, whereas the slide member 14 moves a relatively large distance. In this initial stage, the bolt member 12 primarily rotates around its lower left hand corner as viewed in the drawings. The movement of the bolt member 12 from the position illustrated in FIG. 6 to the position illustrated in FIG. 7 is relatively rapid and the bolt member 12 and and the slide member 14 in combination, have, at that point, attained sufficient momentum which, in combination with the force imparted to the face of the bolt 12 by the cartridge case, will move the bolt member 12 and slide member 14 to an open breach position at which the face of the bolt member 12 is approximately aligned with the back wall of the magazine chamber 20. When the rearward motion of the bolt member 12 and slide member 14 ceases, the recoil springs 64 and 66 will cause the slide member 14 and the bolt member 12 to move forward. During such forward movement of the bolt member 12, another round of ammunition will be stripped from the magazine (not shown) in the magazine chamber 20 and will be chambered in the barrel 18.

Figures 5, 8, 9, 10, 11, 12:
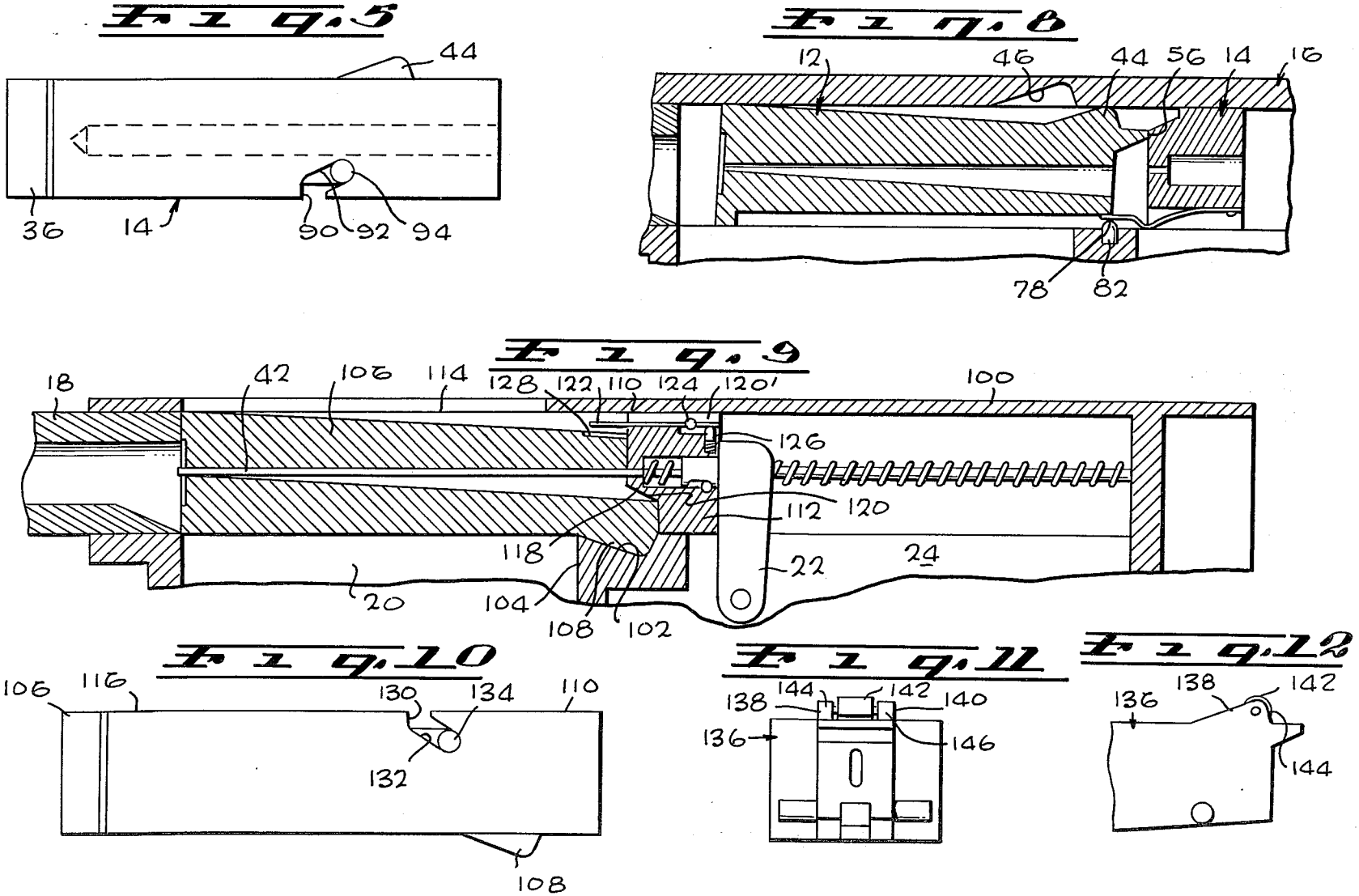
FIG. 5 is a side elevational view of the bolt member and slide member illustrated in FIG. 1.
FIG. 8 is a sectional view similar to that of FIGS. 6 and 7 but with the bolt member illustrated in yet another position.
FIG. 9 is a sectional view along a longitudinal axis of a second embodiment of the bolt mechanism of the present invention.
FIG. 10 is a side elevational view of the bolt member and slide member illustrated in FIG. 9.
FIG. 11 is an elevational view of an alternate form of the bolt member illustrated in FIG. 1.
FIG. 12 is a side elevational view of the bolt member illustrated in FIG. 11.

The body portion 48 of the slide member 14 is provided with a longitudinal slot 76 and (see FIG. 4) in which a leaf spring 78 is secured. A longitudinal slot 80 is provided in a bottom surface of the bolt member 12 (see FIG. 3) and an end of the leaf spring 78 is disposed for engaging an upper surface thereof. A member 82 is mounted in a wall of the receiver frame 16 and provides a projection for lifting the leaf spring 78 as it passes thereover. As shown in FIG. 6, the leaf spring 78 engages the upper surface of the slot 80 as the camming surface 54 is moving off the camming surface 58. Such engagement continues as the locking lug 44 moves out of the locking recess 46 and until the leaf spring 78 moves off the member 82 as shown in FIG. 7. As illustrated in FIG. 8, when the leaf spring 78 has moved off the member 82, it no longer biases the bolt member 12 in an upward direction. Accordingly, as the bolt member 12 moves forward from an open breach position to a closed breach position, there is no upward force imparted to the bolt member 12 until the member 82 engages the leaf spring 78. During that stage of the operation, the body portion 48 of the slide member 14 engages the shoulder 56 on the bolt member 12 to force the bolt member 12 forward. When the bolt member 12 approaches the closed breach position, the member 82 engages the leaf spring 78, thereby lifting the spring and biasing the rearward end of the bolt member 12 in an upward direction. As the bolt member 12 continues toward the closed breach position, the shoulder 56 thereon moves off the forward inner surface of the body portion 48 of the slide member 14, thereby permitting the camming surface 54 to move onto the camming surface 58 and the lug 44 to move into the locking recess 46.

It can be readily appreciated that a conventional cartridge case extractor and ejector can be employed in a combination with the bolt member 12, but are not shown for purposes of clarity illustration and since they form no part of the present invention. An opening 84 is provided in the sidewall 28 of the receiver frame 16 through which a cartridge case can be ejected. A handle 86 is secured to the slide member 14 and extends through a slot 88 which is coextensive with the opening 84 in the side wall 28. As shown in FIG. 5, the slide member 14 is provided with a slot 90 having a camming surface 92. A pin 94 extends from a side of the bolt member 12 into the slot 90. A similar slot and pin are provided on the other side of the slide member 14 and bolt member 12, respectively. When it is desired to manually open the breach of the fire arm, the slide member 14 is translated in a rearward direction by means of the handle 86. The slot 90 is so dimensioned to permit a relatively slight movement of the slide member 14 with respect to the bolt member 12 before the pin 94 engages the camming surface 92. Accordingly when the slide member 14 is moved manually, the camming surface 58 moves out from under the camming surface 54 a slight distance. Further movement of the slide member 14 causes the pin 94 to be cammed in a downward direction by the camming surface 92 to remove the locking lug 44 from the locking recess 46.

A second embodiment of the present invention is illustrated in FIGS. 9 and 10. As shown therein, a receiver frame 100 is disposed for supporting the barrel 18 at one end thereof and the stock of a firearm at the other end thereof. The receiver frame 100 is substantially identical to the receiver frame 16 illustrated in FIG. 1, with the exception that a locking recess 102 is provided in a wall 104 between the magazine chamber 20 and the firing mechanism chamber 24. A bolt member 106 is provided with a locking lug 108 on its bottom surface which is disposed for being received in the locking recess 102.

A slide member 110 is formed of a body portion 112 and a pair of side wall portions 114 and 116. An inner surface of the body portion 112 is provided with a camming surface 118 which is disposed for engaging a camming surface 120 on the bolt member 106. The interaction of the bolt member 106 and the slide member 112, due to the camming surfaces of the recess 102 and the lug 108 and the camming surfaces 118 and 120, is identical to the interaction of the bolt member 12 and slide member 14 illustrated in FIG. 1, with the exception that the bolt member 106 moves upwardly, rather than downwardly.

A longitudinal recess 120 is provided in the body portion 112 of the slide member 110 in which an arm 122 is pivotally mounted on a shaft 124. A spring biased plunger 126 is disposed for engaging one end of the arm 122, with the other end of the arm 122 extending over an upper surface of the bolt member 106. A longitudinal slot 128 is disposed for receiving the end of the arm 122 therein when the lug 108 moves out of the locking recess 102. During such movement of the lug 108 out of the recess 102, the plunger 126 will be depressed, such that upon the return movement of the bolt member 106 to a closed breach position, the bolt member 106 will be biased to move the lug 108 into the recess 102.

A handle (not shown) similar to the handle 86 is secured to the slide member 110 for manually translating the bolt member 106 and the slide member 110 in a rearward direction. A slot 130 having a camming surface 132 is provided in the sidewall portion 116 in the slide member 110 and a pin 134 extends from the bolt member 106 into the slot 130. A similar pin and slot are provided on the opposite side of the bolt member 106 and slide member 110, respectively. The pin 134 in cooperation with the camming surface 132 move the bolt member 106 such that the lug is removed from the recess 102 when the slide member 110 is translated in a rearward direction.

An alternate form of the locking lug is illustrated in FIGS. 11 and 12. As shown therein a bolt member 136 is provided with a pair of lugs 138 and 140 which support a roller bearing 142 therebetween. The lugs 138 and 140 are provided with camming surfaces 144 and 146, respectively which are disposed for engaging the camming surface of a corresponding recess. The camming surface 144 and 146 are approximately tangential to an outer surface of the roller 142, such that as the camming surfaces 144 and 146 move out of the corresponding recess, a surface of the roller 142 will engage the edge thereof. As the bolt member 136 moves longitudinally in the receiver frame, the roller 142 will move along the inner surface of the top wall of the receiver frame. The bolt member 136 illustrated in FIGS. 11 and 12 corresponds to the bolt member 12 illustrated in FIG. 1. It can be readily appreciated, however, that a similar roller arrangement can be provided for the bolt member 106 illustrated in FIG. 9.

Although the recoil springs 64 and 66 have been illustrated as being positioned behind the bolt mechanism, it can be readily appreciated that a recoil spring can also be located in an appropriate chamber extending along the length of the barrel 18. As shown in FIGS. 1 and 9, the hammer 22 will not strike the firing pin 42 unless the slide member 14 has moved to a full forward position. This feature provides a distinct safety advantage in that an ammunition round cannot be fired until the bolt member 12 is locked in its forward position.

It can be readily appreciated from the above that the bolt mechanism of the present invention provides for relatively little displacement of the bolt member while it is being unlocked. This relatively small displacement which is illustrated in FIG. 6 of the drawings is not sufficient to permit the cartridge case to rupture due to extensive stretching thereof. Although the face of the bolt member tends to pivot, the base or bottom wall of the cartridge case is sufficiently stiff to keep the cartridge case from deforming due to such rotation.

Due to the weight of the bolt member and slide member of the present invention, their combined momentum permits a much greater delay in the release of the bolt member during the discharge of a round of ammunition. Accordingly, a bullet can travel a greater distance down the length of the barrel before the bolt member is permitted to completely unlock, since less gas pressure is required in the barrel to move the bolt member and slide member from the position illustrated in FIG. 6 to a completely open breach.

For the purpose of exemplication, particular embodiments of the invention have been shown and described according to the best present understanding thereof. However, it will be apparent that changes and modifications in the arrangement and construction of the parts, including the types of material utilized therein, may be resorted to without departing from the spirit and scope of the invention.

The invention claimed is:

1. In a firearm having a receiver frame having walls and shoulders defining a longitudinal bolt path and equipped to be fitted with a barrel, a delayed action bolt mechanism, comprising:

a. a bolt member having a pair of camming surfaces and disposed for slideable movement along a longitudinal axis along said walls and guide shoulders in the receiver frame between a closed breach position and an open breach position, first and second opposed camming surfaces on said bolt, said bolt having a shoulder on the end thereof;

b. camming means on the receiver frame forming a camming surface disposed for engaging said first camming surface on said bolt member and for exerting a force thereagainst having a first component opposing the movement of said bolt member from the closed breach position toward the open breach position and a second component orthogonal to the longitudinal axis so that said bolt moves away from said camming means as it moves toward the open bolt position; and c. a slide member disposed for slideable movement along said walls and guide shoulders in the receiver frame and having a camming surface disposed for engaging said second camming surface on said bolt member and for exerting a force thereagainst having a first component opposing the movement of said bolt member from the closed breach position toward the open breach position and a second component to move said slide member off said second camming means orthogonal to the longitudinal axis and opposed to the second component of force of said camming means on said receiver frame so that said shoulder axially engages said slide member as said slide member moves off said second camming means.

2. A delayed action bolt mechanism as defined in claim 1, wherein said bolt member is disposed for movement in a direction which is approximately orthogonal to the longitudinal axis to permit said first camming surface thereof to move off the camming surface of said camming means on said receiver frame, thereby permitting said bolt member and said slide member to move together in the receiver frame with said shoulder on said bolt member axially thrusting said slide member.

3. A delayed action bolt mechanism as defined in claim 1, wherein the camming surface of said camming means lies in a first plane and the camming surface of said slide member lies in a second plane, the angle of intersection of said first plane with the longitudinal axis is greater than the angle of intersection of said second plane with the longitudinal axis, such that a relatively small longitudinal disposed of said bolt member results in a relatively larger longitudinal displacement of said slide member.

4. A delayed action bolt mechanism as defined in claim 1, further comprising means for biasing said bolt member in a direction approximately opposed to the direction of the second component of force of said camming means.

5. A delayed action bolt mechanism as defined in claim 4, wherein said bolt member includes a shoulder adjacent the second camming surface thereof and said slide member includes a shoulder adjacent the camming surface thereof, each of which shoulders are disposed for engagement with one another after the second camming surface of said bolt member moves off the camming surface of said slide member, said biasing means being disposed for exerting a force against said bolt member tending to translate said shoulders with respect to one another in a direction to permit the second camming surface of said bolt member to move onto the camming surface of said slide member.

6. A delayed action bolt mechanism as defined in claim 5, wherein said biasing means includes a spring element secured to said slide member and a camming projection secured to the receiver frame and positioned to engage said spring element when said bolt member is approximately positioned to permit movement of the first camming surface thereof onto the camming surface of said camming means.

7. A delayed action bolt mechanism as defined in claim 1, further comprising a handle secured to said slide member, and wherein said bolt member includes means forming a third camming surface thereon and said slide member includes means forming a second camming surface thereon disposed for engagement with the third camming surface of said bolt member, said third camming surface of said bolt member and said second camming surface of said slide member being positioned to bias the first camming surface of said bolt member away from the camming surface of said camming means as said slide member is translated longitudinally by said handle.

* * * * *